US009528801B1

(12) United States Patent
Gold

(10) Patent No.: US 9,528,801 B1
(45) Date of Patent: Dec. 27, 2016

(54) LOW COLLATERAL DAMAGE TUNABLE DIRECTIONAL-LETHALITY EXPLOSIVE FRAGMENTATION AMMUNITION

(71) Applicant: Vladimir M. Gold, Hillside, NJ (US)

(72) Inventor: Vladimir M. Gold, Hillside, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/853,258

(22) Filed: Sep. 14, 2015

(51) Int. Cl.
*F42B 12/00* (2006.01)
*F42B 12/20* (2006.01)

(52) U.S. Cl.
CPC ..... *F42B 12/20* (2013.01)

(58) Field of Classification Search
CPC ..... F42B 12/20; F42B 12/22; F42B 12/02
USPC ..... 102/501, 506, 402, 403; 86/50
See application file for complete search history.

(56) References Cited

U.S. PATENT DOCUMENTS 3,298,308 A * 1/1967 Throner, Jr. ..... F42B 12/32 102/496
3,799,054 A * 3/1974 LaRocca ..... F42B 12/22 102/491
4,106,411 A * 8/1978 Borcher ..... F42B 12/22 102/495
4,745,864 A * 5/1988 Craddock ..... F42B 12/22 102/491
H1047 H * 5/1992 Henderson ..... F42B 12/32 102/364
H1048 H * 5/1992 Wilson ..... F42B 12/32 102/364
5,117,759 A * 6/1992 Henderson ..... F42B 12/32 102/473
6,484,642 B1 * 11/2002 Kuhns ..... F42B 12/24 102/493
7,891,297 B1 * 2/2011 Rohr ..... F42B 12/02 102/265
2003/0172833 A1 * 9/2003 Ronn ..... F42B 12/22 102/489

* cited by examiner

*Primary Examiner* — Joshua Freeman
(74) *Attorney, Agent, or Firm* — Michael C. Sachs

(57) ABSTRACT

A flexible warhead which can be used for a bunker defeat mechanism. The warhead has a polysterene membrane embedded with lethal tungsten alloy fragments, contains an explosive gel, and also has an attached time delay fuze. The warhead is folded and stored in a case. In use, the warhead is expelled from the case by a propellant and the membrane is exploded with its fragments proximate to impacting a target, after the time delay.

11 Claims, 3 Drawing Sheets

LOW COLLATERAL DAMAGE TUNABLE DIRECTIONAL-LETHALITY EXPLOSIVE FRAGMENTATION AMMUNITION

U.S. GOVERNMENT INTEREST

The inventions described herein may be made, used, or licensed by or for the U.S. Government for U.S. Government purposes.

BACKGROUND OF INVENTION

In bunker defeat mechanisms for instance it is desired to provide an improved warhead which can deliver a significantly larger quantity of lethal fragments at an intended target. This invention relates to a warhead having means for efficiently storing and ejecting a multiplicity of lethal fragments in a prescribed target direction. This warhead may also nearly completely eliminate collateral damage to a site, and minimize unintended casualties or injuries to non-combatants.

BRIEF SUMMARY OF INVENTION

The above desired effects are achieved using a warhead having a foldable elastomeric fragmentation encasement, having a closed membrane of adjustable shape and curvature, which will enclose an inner volume of gel or liquid explosive. The elastomeric fragmentation membrane may include a multiplicity of "hinge joint" tungsten alloy fragments, deposited into the elastomeric matrix encasement membrane material. The tungsten alloy fragments may be formed in alternating patterns of triangular, rectangular, pentagon, hexahedral, or other shapes. The patterns may be loosely jointed through transverse "hinge-joint" rotational and extensional connections, held together by the tension of the elastomeric encasement membrane. The membrane can achieve a control over fragment spray direction. The membrane may be deposited into a light weight carbon fiber composite case, and carried within an ammunition. When this warhead is prepared to approach and engage a target site, an auxiliary propellant charge may be set off to eject the folded membrane out of the case.

Once the warhead membrane is ejected; under the action of the propellant's high pressure gases, air drag, the explosive and the membrane's inertial forces, the membrane unfolds into an explosive fragmentation charge of prescribed shape and curvature. It may then be detonated by a programmable time-delayed fuze which was attached to the membrane. According to an embodiment of the invention, "hinge joint" rotational and extensional fragment connections allow for fragmentation membrane flexure, and complete reconstitution when unfolding and unfolded into a prescribed shape. When subjected to rapid acceleration in a direction normal to plane of a "hinge-joint", it can "self-lock", delaying premature escape of high pressure detonation products of the gel or liquid explosive. This would thereby maximize kinetic energy transferred to the lethal fragments. Also according to the invention, folded fragmentation membranes can unfold into a variety of prescribed shapes and fragmentation warhead curvatures, including concave, convex, ellipsoidal, and/or spherical configurations, as may occur.

OBJECTS OF THE INVENTION

Accordingly, it is an object of the present invention to provide a flexible warhead which can be used for a bunker defeat mechanism.

Another object of the present invention is to provide a warhead having a polysterene membrane embedded with tungsten alloy fragments, used to defeat a potential target.

It is a further object of the present invention to provide a flexible warhead which can be folded into a shell such as a bunker defeat mechanism or full up round case, and which flexible warhead can be expelled there from to engage a target.

It is a yet further object of the present invention to provide a flexible warhead with a maximal number of lethal fragments thereon, the fragments having hinged joints to make the warhead more flexible, and further, the fragments are molded directly into said flexible warhead's perimeter.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
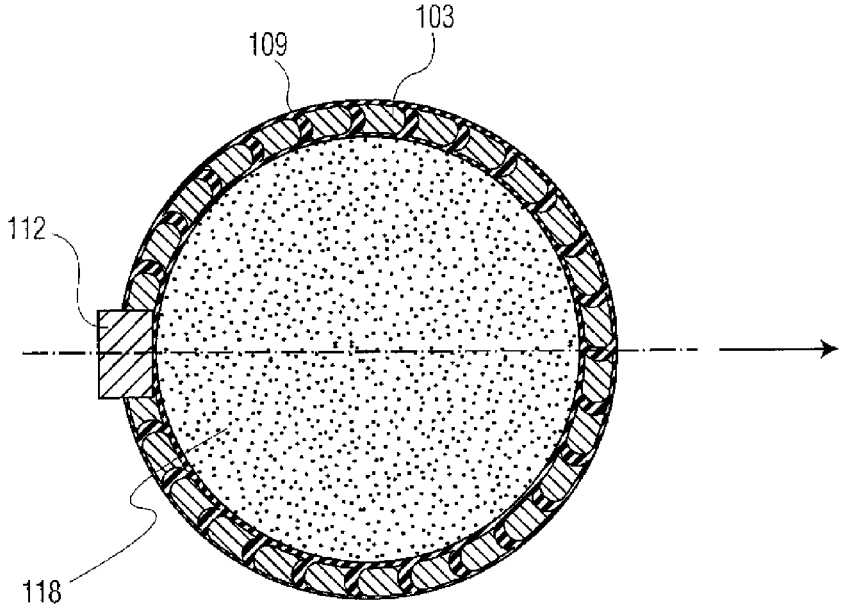
FIG. 1 shows a cross section view of a warhead having a polysterene membrane embedded with tungsten alloy fragments, containing an explosive gel, and also having an attached time delay fuze, according to this invention.
Figure 2:
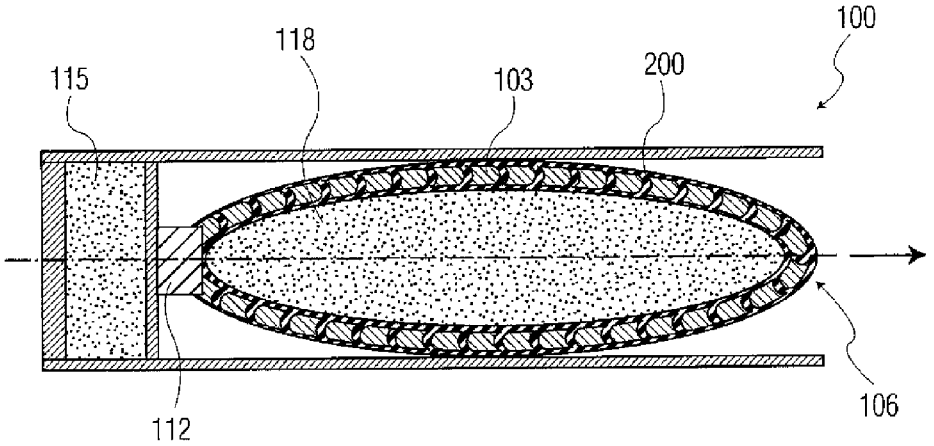
FIG. 2 shows a cross section view of the warhead, with its membrane folded and stored within a case, according to this invention.
Figure 3:
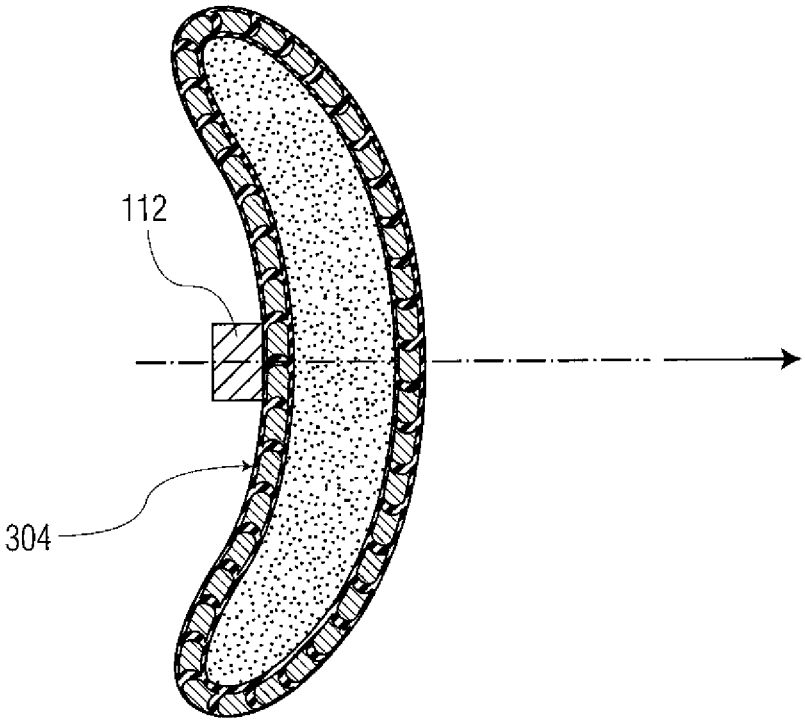
FIG. 3 shows a cross section view of the warhead membrane after it has been expelled from the case by initiating a propellant charge therein, according to this invention.
Figure 4:
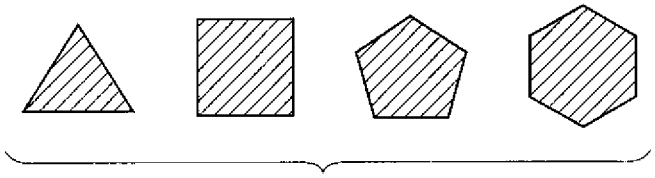
FIG. 4 shows a cross section view of tungsten alloy fragments as planar elements having triangular, rectangular, pentagonal or hexagonal cross sectional shapes, according to this invention.
Figure 5:
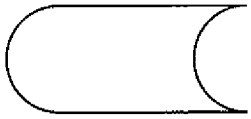
FIG. 5 shows a cross section view of the lateral edge of a tungsten alloy fragment according to this invention.
Figure 6:
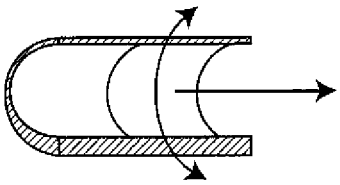
FIG. 6 shows a view of the lateral edge of a tungsten alloy fragment illustrating its possible freedom of movement, according to this invention.

In FIG. 1, a warhead is shown having an elastomeric essentially spheroidal configurated membrane 109 which encloses, for instance, gel or liquid explosive 118, and is detonated through a fuze 112 which is permanently attached to membrane 109. The membrane material may be polysterene material. A plurality of tungsten alloy fragments 103 are embedded in the perimeter of membrane 109. The fragments are present in the mold, e.g., when membrane 109 is manufactured. That is to say, the fragments are molded right into the wall of the membrane perimeter. Nonetheless, the manufacturing may not be perfect and a fragment or fragments may extend out slightly from the surface of the membrane, making the membrane surface imperfect as to smoothness; this however does not affect the operation of the warhead. The membrane perimeter also, is still intact so that it can contain the amounts of gel or liquid explosive 118 present there, without any leaks. Ideally, the fragments have hinge joints with respect to one another, to be explained further here below. For an ordinary target, the fuze 112 might be a proximity type, but in bunker defeat mechanism applications, e.g., the fuze operation is usually based on a time delay. The time delay fuze would begin a countdown sequence upon an impact, such as upon a first ground impact. The intention is that the warhead will then penetrate into the ground and be near the intended target, perhaps inside a room of a below ground bunker, and when the fixed time delay has been reached, that the warhead will then detonate into the intended target. At that time, the target will be attacked and shredded by the plurality of lethal fragments 103. FIG. 2 shows how membrane 109 can be prepared into a folded shape such as 200, to install it into a launching case 100 which case may be made of carbon composite material. Case 100 may be a shell casing of a bunker defeat mechanism cartridge, or of a full up round, for example. A fuze 112 is shown here positioned at the aft location of case 100 behind the folded membrane. The case includes a means 115 for expelling the folded membrane 200 together with its fuze 112 attached thereto. Means for expelling 115 may include a propellant which can be ignited to initiate expulsion of the warhead from case 100. Immediately after expulsion, folded membrane 200 may unfold in flight into an initial shape 304 such as shown in FIG. 3. The membrane is squeezed from behind by escaping propellant gases, also pushed to an extent by moving fuze 112, while retarded in its front regions by air resistance. These may account for the new shape 304. However, as flight continues the membrane begins to assume the spheroidal shape of 109 in FIG. 1 due to air drag on the membrane, tending to pull it out into the spheroidal shape 109. For extra clarity, it should be understood that 109, 200 and 304 are all the same membrane, just in different states of being folded or unfolded or in flight. Various possible cross sectional shapes for the fragments 103 are shown in FIG. 4, such as planar fragments having triangular, square, pentagonal or hexagonal cross sectional shapes, though other shapes are possible. Fragments could also have a rectangular cross sectional shape, e.g. The lateral edges of fragments may also be cupped into either concave or convex shapes as shown in the side views of FIG. 5 or 6. The fragments could then be arranged so they are nested together with each fragment's convex shape edge mated into a concave shaped edge of an adjacent fragment. For rectangular cross sectional fragments, e.g., this would be 2 convex shaped edges and 2 concave shaped edges on each fragment. This allows flexible movement of the membrane with its fragments as the membrane is folded or unfolded, or is in flight, as shown in FIG. 6, and this is what was meant by the fragments being hinge jointed. Many other cross-sectional shapes for the fragments are possible, and ways to nest them together may be similarly applied.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A flexible warhead which can be folded away and stored in a confined space, then expelled and inflated proximate to impacting a target, then armed with a fuze to explode after a prescribed time delay in further direct proximity to said target, said warhead including an inflatable membrane of a flexible material of molded polysterene, with an amount of explosive gel or liquid explosive as a payload within to explode and propel a plurality of tungsten alloy fragments to ultimately impact and shred said target, said fragments being embedded within and all over the perimeter of said membrane, and whereas said fragments are positioned so they all have spaces there in between, yielding a membrane essentially completely embedded with fragments yet still flexible, and there being an expelling charge to expel said flexible warhead from its confined space toward the target, and furthermore adjacent said fragments are arranged to be jointedly attached to one another, and are placed inside said flexible member's perimeter when the member is molded.

2. The warhead of claim 1 wherein said warhead is for a bunker defeat type mechanism.

3. The warhead of claim 1 wherein said fuze is a proximity type fuze instead of a time delay type fuze.

4. The warhead of claim 1 wherein said fuze is an impact type fuze instead of a time delay type fuze.

5. The warhead of claim 1 wherein the fragments are planar with lateral edges that are cupped into a concave or convex shape.

6. The warhead of claim 5 wherein the fragments are arranged hinge jointed, nested together with each fragment's convex shaped edge mated into an adjacent fragment's concave shaped edge.

7. The warhead of claim 5 wherein the planar fragments have a triangular cross sectional shape.

8. The warhead of claim 5 wherein the planar fragments have a rectangular cross sectional shape.

9. The warhead of claim 5 wherein the planar fragments have a pentagonal cross sectional shape.

10. The warhead of claim 5 wherein the planar fragments have a hexagonal cross sectional shape.

11. The warhead of claim 5 wherein the planar fragments have a square cross sectional shape.

* * * * *